United States Patent [19]

King et al.

[11] 3,985,473

[45] Oct. 12, 1976

[54] ROTARY PUMP

[75] Inventors: Robert W. King, Sidney; Robert L. Anderson, De Graff, both of Ohio

[73] Assignee: Copeland Corporation, Sidney, Ohio

[22] Filed: July 10, 1975

[21] Appl. No.: 594,808

[52] U.S. Cl. ..... 417/315; 418/32; 418/224; 418/234; 418/248

[51] Int. Cl.[2] ..... F04B 37/10; F01C 21/16; F04C 15/04

[58] Field of Search ..... 418/32, 63, 224, 234, 418/248–251; 417/315

[56] References Cited

UNITED STATES PATENTS

| | | | |
|---|---|---|---|
| 122,713 | 1/1872 | Faucett | 418/250 |
| 3,039,677 | 6/1962 | Nissley | 418/32 |
| 3,302,869 | 2/1967 | Tchen | 418/239 |

FOREIGN PATENTS OR APPLICATIONS

| | | | |
|---|---|---|---|
| 18,525 | 1897 | United Kingdom | 418/248 |

*Primary Examiner*—John J. Vrablik

*Attorney, Agent, or Firm*—Harness, Dickey & Pierce

[57] ABSTRACT

A rotary pump of the stationary single vane type wherein the vane is arranged to automatically accommodate for the direction of rotor rotation to provide for the flow of fluid through the pump in a single direction regardless of the direction of rotor rotation, the vane also being operable to automatically relieve excessive pressures in the pumping chambers.

17 Claims, 8 Drawing Figures

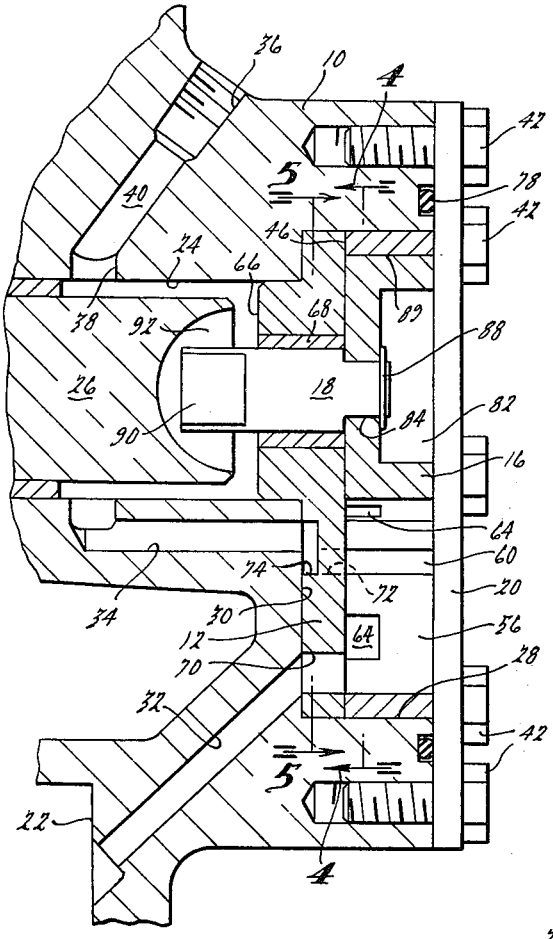
FIG. 3.
FIG. 4.
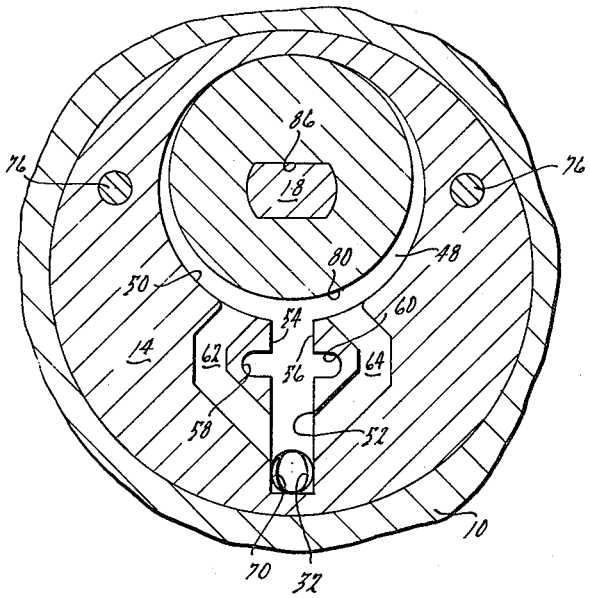
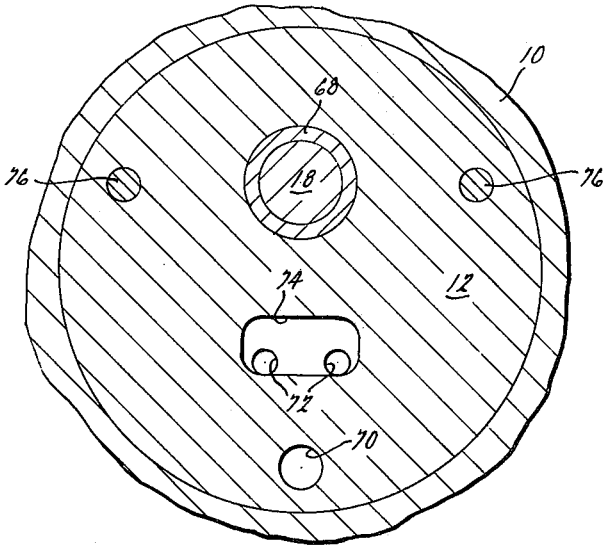
FIG. 5.
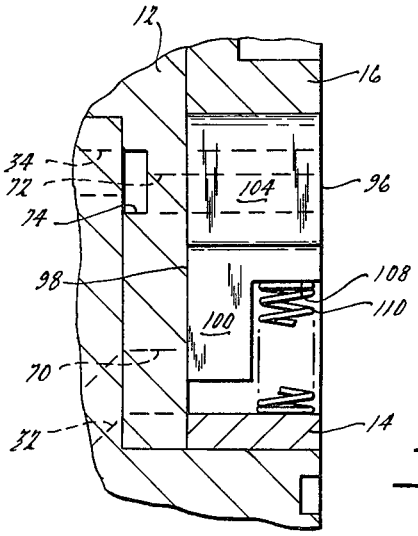
FIG. 6.

ROTARY PUMP

SUMMARY AND BACKGROUND OF THE INVENTION

The present invention pertains to an improved positive displacement pump of the type having a circular rotor eccentrically driven in a circular cylinder having a single vane extending therefrom. One disadvantage of such pumps is that they must be driven in a predetermined direction in order to obtain flow in a given direction through the pump. Although some may be driven in the opposite direction such operation results in a reversal of function of the pump inlet and outlet ports, unless relatively complicated and costly additional valving and/or other parts are provided. The present pump is particularly suited for use as an oil pump for lubricating a refrigeration compressor driven by a three-phase motor, because the start-up of such equipment can result in rotation in either direction.

The primary feature of the present invention resides in the provision of an improved design of this type of pump wherein the single vane automatically controls the flow of fluid through the pump to maintain it in the same direction through the pump regardless of the direction of pump drive.

Another important feature of the present pump resides in the further use of the single vane to relieve excessive pressure in the pumping chamber by permitting it to flow directly from the outlet to the inlet.

The pump of the present invention is also relatively simple in construction and assembly, having very few parts, and is therefore relatively inexpensive.

BRIEF DESCRIPTION OF THE DRAWINGS

FIG. 3 is a sectional view taken along the line 3—3 in FIG. 1 but with the end plate assembled to the pump;

FIG. 4 is a fragmentary sectional view taken along line 4—4 in FIG. 3, but with the vane omitted;

FIG. 5 is a fragmentary sectional view taken along line 5—5 in FIG. 3;

FIG. 6 is an enlarged fragmentary sectional view taken along line 6—6 in FIG. 1;

DETAILED DESCRIPTION OF THE PREFERRED EMBODIMENT

Figure 1:
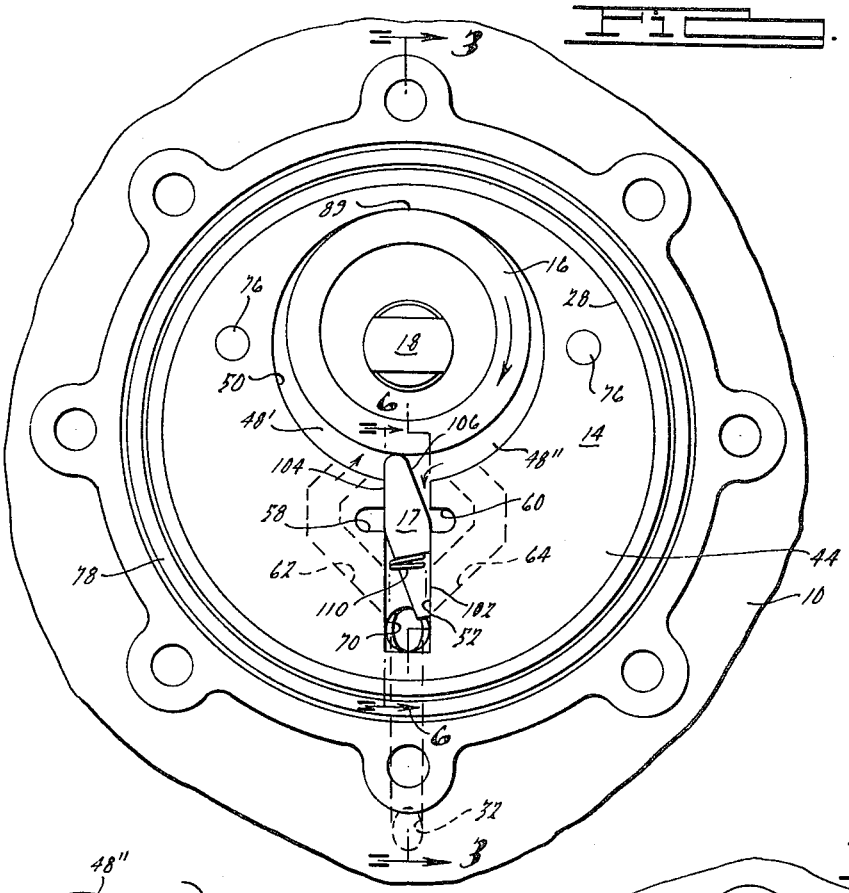
FIG. 1 is a side elevational view of a pump embodying the principles of the present invention with the end plate removed to show the internal workings thereof.

Although the pump of the present invention can take many forms, it is illustrated for exemplary purposes assembled to the end of a refrigeration compressor and operating for the purpose of supplying lubricating oil to the working parts of the compressor, i.e. a typical installation and application for such a pump. The basic parts of the pump, which are relatively few in number, are a pump housing 10, a bearing plate 12, a cylinder 14, an impeller or rotor 16, a vane 17, a drive shaft 18 and an end plate 20.

Pump housing 10 may be of any desired external configuration and in the embodiment illustrated is provided with a suitable mounting surface 22 adapted to fit upon the housing of a conventional refrigerant compressor, such as one of the well know "Copelametic" type illustrated in U.S. Pat. No. 2,298,749. Housing 10 additionally comprises a central opening 24 adapted to receive the free end of the compressor drive shaft, indicated at 26, and an outwardly open recess 28 in which the pumping mechanism is located, the bottom of recess 28 being a generally flat surface 30 extending in a plane generally transverse to the axis of rotation of drive shaft 18. For purposes of this disclosure, the terms "axially," "radially" and "transversely" are made with reference to the center axis of rotation of drive shaft 18. Pump housing 10 has an inlet passageway 32 placing the pump in communication with the interior of the compressor (not shown) or any other desired source of inlet fluid, and with an outlet passageway 34 placing the pump in fluid communication with outlet port 36 via an annular passageway 38 surrounding opening 24 and an intermediate passageway 40, as best seen in FIG. 3. If desired, the end of compressor shaft 26 may be drilled to provide for a flow of lubricating oil from opening 24 to the shaft bearings and like parts. The open end of recess 28 is closed by means of a generally flat end plate 20 which is secured in place by a plurality of machine screws or the like, indicated at 42.

Disposed within recess 28 is a cylinder 14 which is generally circular in configuration having substantially parallel opposed end faces 44 and 46, and a pumping cavity 48 defined by a circular cylindrical inner peripheral surface 50. Cavity 48 has radially extending therefrom an axially disposed slot 52 having generally parallel opposed side faces 54 and 56. Slot 52 and cavity 48 extend all the way through cylinder 14 in the axial direction. As best seen in FIGS. 1 and 4, a pair of discharge passageways 58 and 60 straddle slot 52 in the form of grooves or recess extending the full axial extent of faces 54 and 56, respectively, In addition, a pair of inlet passageways 62 and 64 are provided on face 46 of cylinder 14 in the form of a pair of grooves which serve to place cavity 48 in communication with the lower end of groove 52, as shown best in FIGS. 3 and 4. Passageways 62 and 64 intersect cavity 48 at spaced points on opposite sides of and adjacent slot 52.

Face 46 of cylinder 14 seats against bearing plate 12, which is of the same general external configuration as cylinder 14, but which is provided with a hub portion 66 nesting within opening 24 of housing 10 and central opening in which is located a bearing 68 which rotatably supports drive shaft 18 in the manner best illustrated in FIG. 3. Bearing plate 12 is provided with an inlet passageway 70 which places the bottom (as shown) of slot 52 in fluid communication with inlet passageway 32 in housing 10. In addition a pair of outlet passageways 72 extend through bearing plate 12 and communicate with a cavity 74 on the left hand face of plate 12 as shown in FIG. 3 to thereby place outlet passageways 58 and 60 in fluid communication with outlet passageway 34 in housing 10, as best illustrated in FIGS. 3 and 5. Assembly of the pump is facilitated by the use of locating pins 76 which extend at least in part through bearing plate 12 and cylinder 14. A conventional O-ring and groove, such as indicated at 78 may be provided to seal the end plate with respect to the pump housing.

Figure 8:
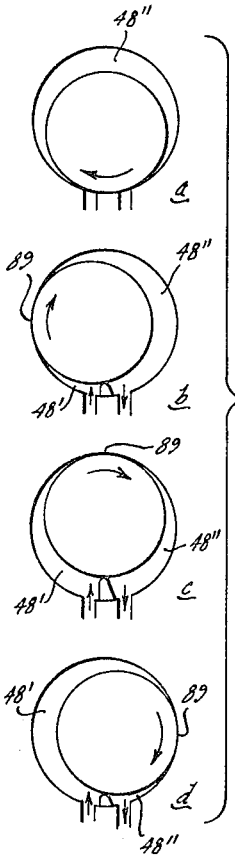
FIG. 8 is a schematic illustration of the pump in four consecutive rotor positions encompassing 360° of rotation.

Disposed within cavity 48 is rotor 16, having a circular cylindrical outer peripheral surface 80 which is smaller in diameter than surface 50 of cavity 48 but of substantially the same width as cylinder 14. If desired, one face of the rotor may be relieved, as indicated at 82 in FIG. 3. Drive shaft 18 has a flattened end portion 84 which drivingly fits within a complementary shaped opening 86 in rotor 16. The center axis of opening 86 is slightly eccentric to the center of cavity 48, whereby the rotor moves with an eccentric rotating motion within the cavity in the conventional manner to provide pumping chambers of progressively increasing and decreasing volume. The degree of eccentricity and the other dimensions of the rotor and cavity are all chosen in accordance with standard criteria for pumps of this basic character. As can be seen, the amount of eccentricity is equal to one-half the difference in diameters of the rotor and cylinder (with provision for minimal clearance) so that a seal point 89 is created between the rotor and cylinder, this seal point rotating with rotation of the rotor as shown in FIG. 8. Drive shaft 18 and rotor 16 are maintained in engagement by means of a shaft retainer ring 88 disposed in a suitable circumferential groove about the end of shaft portion 84. The opposite end of shaft 18 is similarly flattened, as at 90, and projects into a slot 92 formed in the end of compressor crankshaft 26, thus providing a driving connection between the compressor crankshaft and the pump drive shaft.

Figure 7:
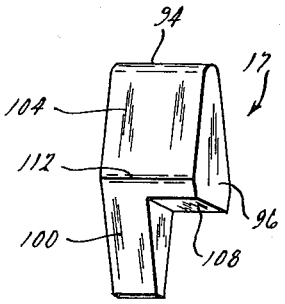
FIG. 7 is an enlarged perspective view of the vane of the present pump.

Slidingly and rockingly disposed within slot 52 is vane 17, which is best illustrated in FIG. 7. As can be seen, vane 17 is generally diamond shaped in cross-section (taken in a plane transverse to the axis of the pump), having a tip 94 adapted to sealingly engage the outer peripheral surface 80 of rotor 16, axially disposed end faces 96 and 98 spaced apart a distance equal to the thickness of cylinder 14 less sufficient clearance to permit freedom of movement without excessive leakage, and four generally flat valve surfaces indicated at 100, 102, 104 and 106. Vane 17 is also provided at one corner with a notch having a surface 108 disposed generally parallel to the edge of tip 94 and against which is disposed a conventional compression coil spring 110 which serves to resiliently bias the vane into sealing engagement with the outer surface of rotor 16 in all positions thereof, as best shown in FIGS. 1 and 6. Vane 17 has on each side thereof a rounded ridge 112 having a radius equal to one-half the width of slot 52 (less clearances) in order to facilitate the rocking thereof in slot 52. Vane 17 may be relatively inexpensively molded from a filled nylon material or from a sintered metal.

Figure 2:
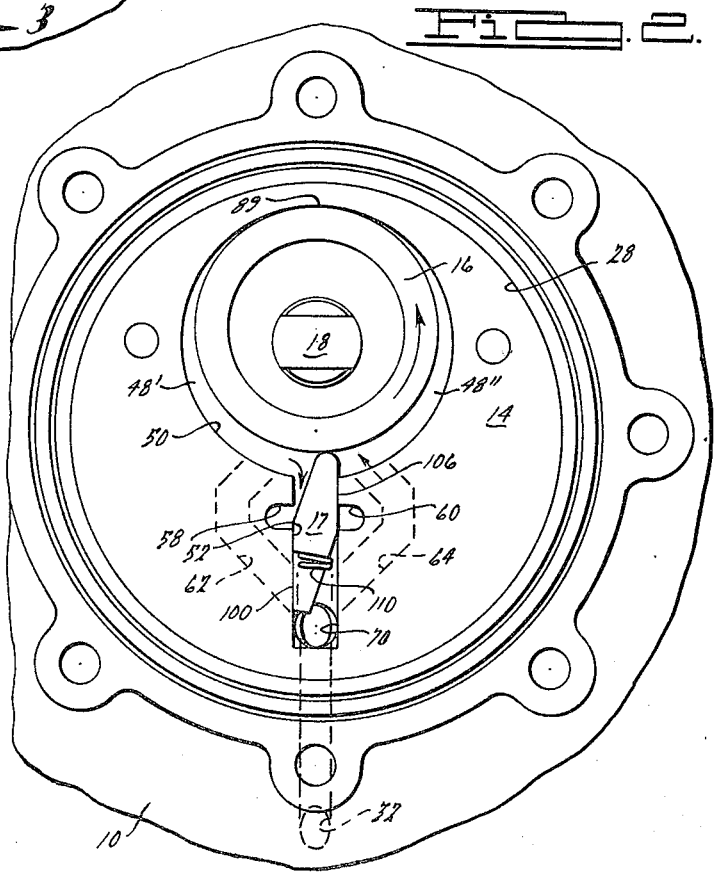
FIG. 2 is a view similar to FIG. 1 but showing the pump operating in a reverse direction of rotation.

The operation of the pump is best understood with reference to FIGS. 1, 2 and 8. In FIG. 1 the rotor is shown rotating in the clockwise direction. With this direction of rotation vane 17 assumes the position illustrated due to the influence of the moment created by the friction of its tip upon the rotor, as well as the influence of fluid pressures. As can be visualized, the pumping chamber is defined by the outer periphery of rotor 16, inner periphery 50 of cavity 48, end plate 20 and bearing plate 12. As the rotor rotates with its eccentric motion a chamber 48' is formed between seal 89 and the left side of vane 17, as shown. This can be seen by comparing FIG. 8b to FIG. 8*a*. Further rotation of the rotor results in a further increase in the volume of chamber 48', as shown in FIGS. 8*c* and 8*d*, until it reaches its maximum volume at the position illustrated in FIG. 8*a*, from which position the chamber, now indicated at 48'', decreases in volume with further rotation of the rotor, as can be seen in FIGS. 8*b* through 8*d*. Vane 17 slides radially in slot 52 as the rotor rotates, sealing contact with the latter being maintained by spring 110.

The pump is of the positive displacement type and as the pumping chamber increases in volume fluid to be pumped is drawn in through passageway 62 (for the direction of rotation illustrated in FIG. 1) via slot 52 and passageways 70 and 32. As the pumping chamber decreases in volume pressurized fluid is displaced via slot 52 into outlet passageways 60, 72, 74, 34, 38 and 40, which deliver pumped fluid to outlet port 36. As can be seen with reference to FIG. 8, each revolution of rotor 16 causes a pumpting chamber discharge, however for a single pumping chamber to complete its full intake and discharge cycle two revolutions of the rotor are required. The capacity of the pump equals the total volume of the cavity per revolution of the rotor.

Vane 17 is held in the position illustrated in FIG. 1 not only by the friction created by its engagement with the rotor but also by the pressure of discharge fluid acting on face 106 of the vane. In this regard, vane 17 is preferably shaped so that the effective area of the faces thereof disposed between ridge 112 and tip 94 is greater than the area of the faces on the opposite side of ridge 112. The flow of fluid under discharge pressure into the inlet via passage 64 is normally prevented by the action of valve surface 102 on the vane which blocks passageway 64 where it meets groove 52. Similarly, the flow of discharge fluid into the inlet side of the pump via passageway 58 and/or slot 52 is prevented by valve surface 104 on vane 17 which acts to block or close passageway 58. Each of the valve surfaces is of sufficient extent to close its respective passageway in all radially displaced positions of the vane.

Operation of the rotor in the opposite direction is illustrated in FIG. 2, where it can be seen that friction and discharge pressure cause the vane to move to the position shown. In that mode of operation passageway 64 acts as the inlet passageway and passageway 62 is blocked by valve surface 100 on vane 17. Similarly, passageway 58 acts as the outlet passageway and passageway 60 is blocked by valve surface 106. One very advantageous feature of the present invention is that the vane will automatically assume the proper position for the direction of rotor rotation encountered, so that the pump will always pump from the same pump inlet port to the same pump outlet regardless of the direction of rotation.

The pump of the present invention also provides an additional advantage in that in the event excessive pressures are encountered in the pumping chamber the vane is free to move or slide against the bias of spring 110. Thus the spring should be chosen so that when an excessive pressure is reached in the pumping chamber the spring will compress to cause tip 94 of the vane to move away from the surface of the rotor and thus place the pump outlet in communication with the pump inlet, thereby relieving the excessive pressure problem. Upon relief of the excessive pressure the vane will return to its normal operating position. This capability is enhanced by the fact that a greater effective area of the vane is exposed to discharge pressure than to inlet pressure.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

We claim:

1. A rotary pump comprising:

a housing having an inner peripheral surface defining a cavity;

a rotor having an outer peripheral surface disposed in said cavity;

means for rotating said rotor in said cavity, said rotor and cavity defining between said inner and outer peripheral surfaces a rotating pump chamber having a volume which increases and decreases as said rotor is driver;

a fluid inlet passageway comminicating with said cavity;

a fluid outlet passageway communicating with said cavity; and single vane means normally sealingly engaging the entirety of said outer peripheral surface of said rotor and said inner peripheral surface of said cavity in all relative positions thereof, said vane means being operable to control the flow of fluid through said inlet passageway and said outlet passageway, and being movable between a first position in which fluid is pumped from said inlet passageway to said outlet passageway when said rotor rotates in one direction and a second position in which said vane means causes fluid to be pumped from said inlet passageway to said outlet passageway when said rotor rotates in the opposite direction.

2. A rotary pump comprising:

a housing having an inner peripheral surface defining a cavity;

a rotor having an outer peripheral surface disposed in said cavity;

means for rotating said rotor in said cavity, said rotor and cavity defining between said inner and outer peripheral surfaces a rotating pumping chamber having a volume which increases and decreases as said rotor is driven;

a pair of fluid inlet passageways communicating with said cavity;

a pair of fluid outlet passageways communicating with said cavity; and a vane normally sealingly engaging said outer peripheral wall of said rotor and said inner peripheral wall of said cavity in all relative positions thereof, said vane having valve means thereon for blocking one inlet passageway and one outlet passageway when said rotor is rotating in one direction and for blocking the other inlet passageway and other outlet passageway when said rotor is rotating in the opposite direction.

3. A rotary pump comprising:

a housing having an inner peripheral surface defining a cavity;

a rotor having an outer peripheral surface disposed in said cavity;

means for rotating said rotor in said cavity, said rotor and cavity defining between said inner and outer peripheral surfaces a rotating pumping chamber having a volume which increases and decreases as said rotor is driven;

a pair of fluid inlet passageways communicating with each other and with said cavity at spaced locations;

a fluid outlet passageway communicating with said cavity; and single vane means mounted in said housing and normally sealingly engaging the entirety of said outer peripheral surface of said rotor in all rotational positions thereof, said vane means being disposed between said spaced locations where said inlet passageways communicate with said cavity and being operable to prevent the flow of inlet fluid through one of said pair of inlet passageways when said rotor is rotating in one direction and the other of said pair when said rotor is rotating in the opposite direction, said vane means also being operable to control the flow of fluid through said outlet passageway.

4. A rotary pump comprising:

a housing having an inner peripheral surface defining a cavity;

a rotor having an outer peripheral surface disposed in said cavity;

means for rotating said rotor in said cavity, said rotor and cavity defining between said inner and outer peripheral surfaces a rotating pumping chamber having a volume which increases and decreases as said rotor is driven;

a pair of fluid outlet passageways communicating with each other and with said cavity at spaced locations;

a fluid inlet passageway communicating with said cavity; and vane means mounted in said housing and normally sealingly engaging said outer peripheral surface of said rotor in all rotational positions thereof, said vane means being disposed between said spaced locations where said outlet passageways communicate with said cavity and being operable to prevent the flow of outlet fluid through one of said pair of outlet passageways when said rotor is rotating in one direction and the other of said pair when said rotor is rotating in the opposite direction.

5. A rotary pump comprising:

a housing having an inner peripheral surface defining a cavity;

a rotor having an outer peripheral surface and axially spaced ends, said rotor being disposed in said cavity;

side wall means enclosing said cavity and sealingly engaging said ends of said rotor;

means for rotating said rotor in said cavity with an eccentric motion whereby a rotating pumping chamber is defined having a volume which increases and decreases as said rotor is driven;

means defining a slot extending into said housing from said inner peripheral surface;

a first fluid inlet passageway communicating with said cavity on one side of and adjacent said slot;

a second fluid inlet passageway communicating with said cavity on the opposite side of and adjacent said slot;

first and second fluid outlet passageways communicating with said cavity; and a vane mounted for movement in said slot, said vane moving to a first position in response to rotation of said rotor in one direction and to a second position in response to rotation of said rotor in the opposite direction, said vane having a tip position adapted to sealingly engage said peripheral surface of said rotor in all operable positions thereof, and being operable to close said first outlet passageway and said second inlet passageway when in said first position, and said second outlet passageway and said first inlet passageway when in said second position.

6. A rotary pump as claimed in claim 5, wherein said vane moves from one of said positions to the other solely in response to frictional forces generated by said rotor and to the pressure of outlet fluid in said cavity.

7. A rotary pump as claimed in claim 5, further comprising spring means biasing said vane in a direction out of said slot toward said rotor, said spring means operable to permit said vane to move away from said rotor in response to a predetermined pressure in said cavity.

8. A rotary pump comprising:

a housing having a circular cylindrical inner peripheral surface defining a cavity;

a rotor having a circular cylindrical outer peripheral surface and axially spaced ends, said rotor being disposed in said cavity;

side wall means enclosing said cavity and sealingly engaging said ends of said rotor;

means for rotating said rotor in said cavity with an eccentric motion whereby a rotating pumping chamber is defined having a volume which increases and decreases as said rotor is driven;

mens defining an axially disposed slot extending generally radially into said housing from said inner peripheral surface;

a first fluid inlet passageway placing a first portion of said slot in communication with said cavity on one side of and adjacent said slot, said first portion of said slot being spaced from said cavity;

a second fluid inlet passageway placing said first portion of said slot in communication with said cavity on the opposite side of and adjacent said slot;

inlet passage means for supplying inlet fluid to said first portion of said slot;

first and second fluid outlet passageways communicating with opposite sides of said slot, respectively, adjacent said cavity;

a vane mounted for rocking and sliding movement in said slot, said vane rocking to a first position in response to rotation of said rotor in one direction and to a second position in response to rotation of said rotor in the opposite direction, said vane having a tip portion adapted to sealingly engage said peripheral surface of said rotor in all operable positions thereof, a first valve means adapted to close said first outlet passageway when in said first position and said second outlet passageway when in said second position, and a second valve means adapted to close said second inlet passageway when in said first position and said first inlet passageway when in said second position; and spring means biasing said vane into sealing engagement with said peripheral surface of said rotor in all positions thereof.

9. A rotary pump as claimed in claim 8, wherein said first inlet passageway and said first outlet passageway are disposed on the same side of said slot and said second inlet passageway and said second outlet passageway are disposed on the opposite side of said slot.

10. A rotary pump as claimed in claim 8, wherein the side faces of said slot are generally parallel to one another.

11. A rotary pump as claimed in claim 8, wherein said vane is generally diamond shaped in cross-section.

12. A rotary pump as claimed in claim 8, wherein said first and second inlet passageways are disposed on opposite sides of said slot.

13. A rotary pump as claimed in claim 8, wherein said first and second outlet passageways are disposed on opposite sides of said slot.

14. A rotary pump as claimed in claim 8, wherein said vane rocks generally about an axially extending axis.

15. A rotary pump as claimed in claim 8, wherein said vane is provided with axially extending rounded ridges on opposite sides thereof, each side ridge having a radius in section equal to approximately one-half the width of said slot less clearances, said vane being adapted to rock on said ridges.

16. A rotary pump as claimed in claim 8, wherein said first valve means is actuated in part by the influence of the pressure of discharge fluid in said cavity acting thereon.

17. A rotary pump as claimed in claim 16, wherein the effective area of said first valve means is greater than the effective area of said second valve means.

* * * * *

UNITED STATES PATENT AND TRADEMARK OFFICE

CERTIFICATE OF CORRECTION

PATENT NO. : 3,985,473

DATED : October 12, 1976

INVENTOR(S) : Robert W. King and Robert L. Anderson

It is certified that error appears in the above-identified patent and that said Letters Patent are hereby corrected as shown below:

Column 2, line 39, "," should be --.--

Column 4, line 14, "pumpting" should be --pumping--

Claim 1, Column 5, line 12, "pump" should be --pumping--

Claim 1, Column 5, line 13, "driver" should be --driven--

Claim 5, Column 6, line 64, "position" should be --portion--

Claim 8, Column 7, line 26, "mens" should be --means--

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*